US011835042B2

(12) United States Patent
Lee

(10) Patent No.: US 11,835,042 B2
(45) Date of Patent: Dec. 5, 2023

(54) PUMP FOR SPRAYING LIQUID

(71) Applicant: SAMHWA CO., LTD, Uiwang-si (KR)

(72) Inventor: Kyungchang Lee, Uiwang-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 134 days.

(21) Appl. No.: 17/369,902

(22) Filed: Jul. 7, 2021

(65) Prior Publication Data

US 2022/0056905 A1 Feb. 24, 2022

(30) Foreign Application Priority Data

Aug. 24, 2020 (KR) ..... 10-2020-0106162
Nov. 19, 2020 (KR) ..... 10-2020-0155105

(51) Int. Cl.

| | |
|---|---|
| ***F04B 7/00*** | (2006.01) |
| ***F04B 19/22*** | (2006.01) |
| ***F04B 53/10*** | (2006.01) |
| ***F04B 53/12*** | (2006.01) |

(52) U.S. Cl.

CPC ..... *F04B 7/0073* (2013.01); *F04B 19/22* (2013.01); *F04B 53/108* (2013.01); *F04B 53/121* (2013.01)

(58) Field of Classification Search

CPC .... F04B 7/0073; F04B 19/22; F04B 39/0016; F04B 53/12; F04B 53/108; F04B 7/04; F04B 53/121; A45D 2200/055; B05B 11/1001; B05B 11/10; B05B 11/109; B05B 11/1023; B05B 11/1025; B05B 11/01; B05B 11/1042

See application file for complete search history.

(56) References Cited

U.S. PATENT DOCUMENTS

| | | | | |
|---|---|---|---|---|
| 5,803,318 | A * | 9/1998 | Lina | B05B 11/1047 222/321.2 |
| 6,196,424 | B1 * | 3/2001 | Bougamont | B05B 11/1026 222/321.9 |
| 6,685,062 | B1 * | 2/2004 | Ki | B05B 11/1025 222/321.9 |
| 8,631,976 | B2 * | 1/2014 | Moretti | B05B 11/1008 222/321.2 |
| 11,203,026 | B2 * | 12/2021 | Ding | B05B 11/1074 |
| 2008/0210713 | A1 * | 9/2008 | Langlois | B05B 11/1008 222/321.9 |

(Continued)

FOREIGN PATENT DOCUMENTS

| | | |
|---|---|---|
| KR | 10-1963619 B1 | 3/2019 |
| KR | 10-1975847 B1 | 5/2019 |

*Primary Examiner* — Bryan M Lettman
(74) *Attorney, Agent, or Firm* — Park, Kim & Suh, LLC

(57) ABSTRACT

A pump for spraying liquid includes a housing having an interior space holding liquid, a guide moving up and down within the interior space and having an inlet hole connecting with the interior space, and a piston moving with the guide while maintaining a contact with the housing and the guide. The pump further includes a valve coupled to and connecting with the guide, a shoulder coupled to an upper portion of the housing, and an elastic member having one end in contact with the shoulder and the other end in contact with the valve to provide an elastic force pushing the valve upward. The elastic member includes a center portion and upper and lower deformation portions which are formed as an integrated body.

5 Claims, 12 Drawing Sheets

(56) References Cited

U.S. PATENT DOCUMENTS

| | | | | |
|---|---|---|---|---|
| 2015/0090741 | A1* | 4/2015 | Laffey | F16F 1/025 222/321.9 |
| 2015/0136810 | A1* | 5/2015 | Ding | B05B 11/1074 222/321.9 |
| 2017/0198691 | A1* | 7/2017 | Tu | F04B 19/22 |
| 2017/0341097 | A1* | 11/2017 | Brugger | F04B 53/14 |
| 2018/0171998 | A1* | 6/2018 | Sun | F04B 53/14 |
| 2023/0074980 | A1* | 3/2023 | Zembrod | F04B 45/02 |

* cited by examiner

PUMP FOR SPRAYING LIQUID

CROSS-REFERENCE TO RELATED APPLICATIONS

This application claims the benefit of Korean Patent Application No. 10-2020-0106162, filed with the Korean Intellectual Property Office on Aug. 24, 2020, and Korean Patent Application No. 10-2020-0155105, filed with the Korean Intellectual Property Office on Nov. 19, 2020. The disclosures of the above patent applications are incorporated herein by reference in their entirety.

BACKGROUND

1. Technical Field

The present invention relates to a pump for spraying a liquid that has a simple composition and is easy to recycle.

2. Description of the Related Art

In a cosmetic container and the like, a pump is coupled to the opening at the upper part of a container holding a liquid content such as a cosmetic, etc., to dispense and spray the content to the exterior in designated amounts. When the user presses down on a nozzle corresponding to a button so as to spray the liquid content, the content that had been supplied within the cosmetic container is pressurized, moved upward along the discharge passage, and sprayed through the nozzle. When the pressure on the nozzle is released, the discharge passage is mechanically closed by the rising of the nozzle, the pressure inside the pump is decreased, and the content is drawn in from the container to compensate.

A cosmetic container equipped with a pump such as the above is being used not only for spraying perfumes and cosmetics but also a variety of other contents such as shampoos, air fresheners, insecticides, etc. Due to the convenience of dispensing designated amounts of a content with a single pressing of the nozzle without having the content exposed to outside air, use of such container continues to grow.

A cosmetic container equipped with a spray pump is disclosed in Korean Registered Patent No. 1963619. The cosmetic container disclosed in the prior art document includes a nozzle, nozzle cap, cap cover, cap, valve, valve spring, housing cover, piston spring, piston, guide, disk, and housing, among others, and hence has a complicated structure that is difficult to fabricate. Also, the conventional cosmetic container may include a valve spring and a piston spring, which may be made of a metallic material, differing in material from the other parts made of plastic and making it difficult to recycle the container. Recent interest in and awareness of the need for environment friendliness has increased the demand for cosmetic containers that are easy to recycle, but the conventional cosmetic container fails to meet such demand.

SUMMARY OF THE INVENTION

Therefore, an aspect of the invention, which was conceived to resolve the problems above, is to provide a pump for spraying a liquid that has a simple structure and is easy to recycle.

Other objectives of the present invention will be more clearly understood from the embodiments set forth below.

A pump for spraying a liquid according to one aspect of the invention can include a housing provided with an interior space in which a content may be received; a guide that is configured to move up and down within the interior space and has an inlet hole that can connect with the interior space; a piston that is configured to move according to an upward and a downward movement of the guide while maintaining contact with an inner perimeter of the housing and an outer perimeter of the guide and is capable of closing the inlet hole; a valve that is coupled to and connects with an upper portion of the guide and protrudes to the exterior of the housing; a shoulder coupled to an upper portion of the housing; and an elastic member having one end contacting the shoulder and the other end contacting the valve to provide an elastic force for pushing the valve upward, where the elastic member can include a center portion and deformation portions formed on both ends of the center portion such that the elastic member is capable of elastic deformation, and the center portion and the deformation portions can be formed as an integrated body.

A pump for spraying a liquid according to another aspect of the invention can include a housing provided with an interior space in which a content may be received; a guide that is configured to move up and down within the interior space and has an inlet hole that can connect with the interior space; a piston that is configured to move according to an upward and a downward movement of the guide while maintaining contact with an inner perimeter of the housing and an outer perimeter of the guide and is capable of closing the inlet hole; a valve that is coupled to and connects with an upper portion of the guide and protrudes to the exterior of the housing; a shoulder coupled to an upper portion of the housing; and an elastic member having one end contacting the shoulder and the other end contacting the valve to provide an elastic force for pushing the valve upward, where the elastic member can have the shape of a hollow cylinder with slit portions and connection portions formed in its periphery.

A pump for spraying a liquid according to an embodiment of the invention can include one or more of the following features. For example, the center portion can remain undeformed.

The housing, guide, piston, valve, shoulder, and elastic member can be formed from the same material.

The pump for spraying a liquid can be formed from polypropylene (PP).

The shoulder can include a shoulder flange, the shoulder flange can have a shoulder protrusion formed thereon, the elastic member can include a placement ring positioned on the shoulder flange, and the placement ring can have an insertion groove formed therein, into which the shoulder protrusion may be inserted.

The elastic member can be formed as an integrated body with the shoulder.

The connection portion can include first connection portions and second connection portions formed alternatingly along a lengthwise direction, where the first connection portions and second connection portions can be arranged perpendicularly to each other.

An embodiment of the invention described above can provide various advantages, including the following. However, a structure can constitute an embodiment of the invention without necessarily providing all of the advantages below.

An embodiment of the invention can provide a pump for spraying a liquid that has a simple structure and is easy to recycle.

DETAILED DESCRIPTION OF THE INVENTION

Figure 1:
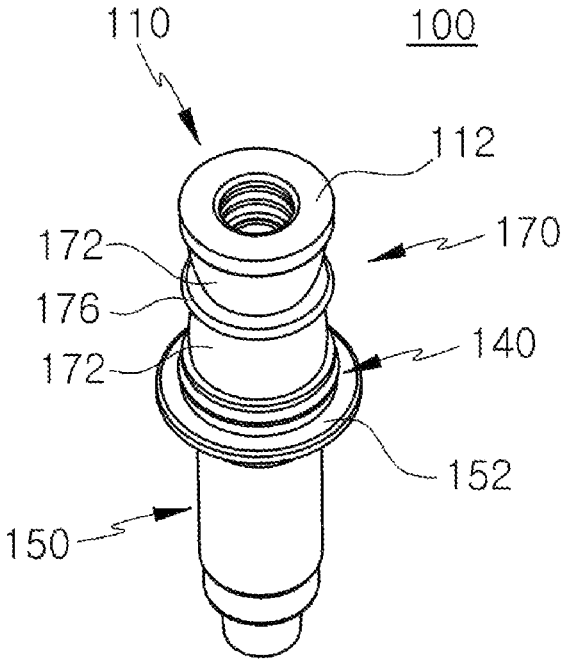
FIG. 1 is a perspective view illustrating a pump for spraying a liquid according to a first disclosed embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted, if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., may be used to describe various components, such components must not be limited to the above terms. The above terms are used only to distinguish one component from another.

Certain embodiments of the invention will be described below in more detail with reference to the accompanying drawings. Those components that are the same or are in correspondence are rendered the same reference numeral, and redundant descriptions are omitted.

Figure 2:
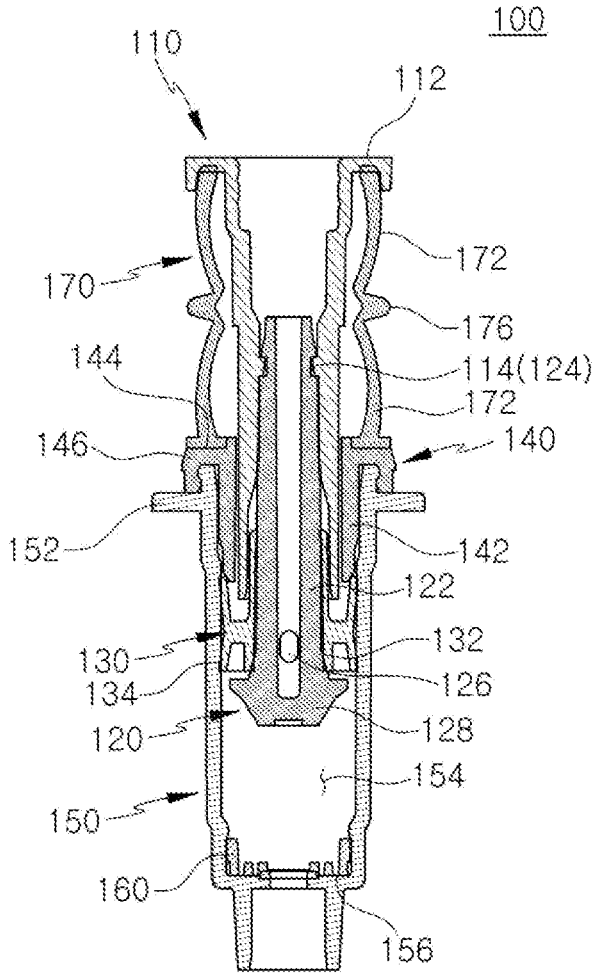
FIG. 2 is a vertical cross-sectional view across the center of the pump for spraying a liquid illustrated in FIG. 1.

FIG. 1 is a perspective view illustrating a pump 100 for spraying a liquid according to a first disclosed embodiment of the invention, and FIG. 2 is a vertical cross-sectional view across the center of the pump 100 for spraying a liquid illustrated in FIG. 1.

Referring to FIG. 1 and FIG. 2, a pump 100 for spraying a liquid based on this embodiment may use an elastic member 170 made from plastic resin or silicone, etc., in lieu of a conventional coil spring made from a metallic material. The elastic member 170 may have the shape of an hourglass with a tube-shaped center portion 176 protruding from the center, so as to be folded and elastically compressed when an external force is applied and be elastically restored to upwardly push the valve 110 and guide 120 when the external force is removed. As the elastic member 170 is formed from the same material as that of other components of the pump 100, it may be easier to recycle the pump 100.

Since the pump 100 for spraying a liquid based on the first disclosed embodiment includes the valve 110, guide 120, piston 130, shoulder 140, housing 150, disk 160, and elastic member 170, the composition is simpler compared to the conventional pump for spraying a liquid, allowing easier fabrication as well as decreased manufacturing cost.

Figure 3:
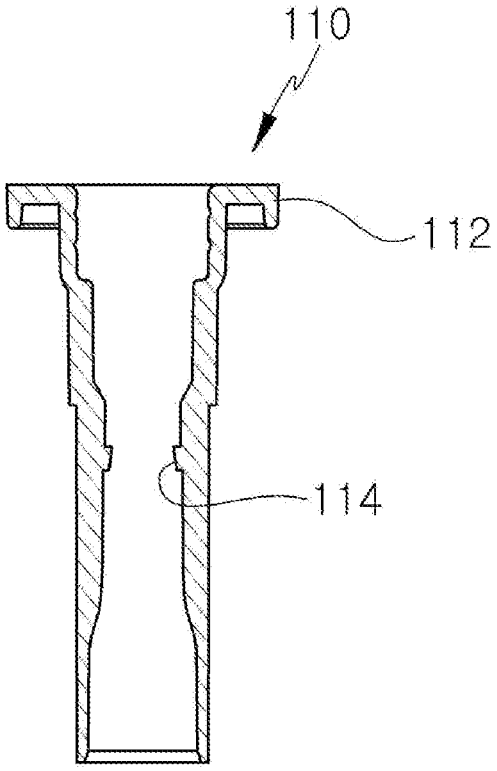
FIG. 3 is a vertical cross-sectional view across the center of the valve in the pump for spraying a liquid illustrated in FIG. 1.

FIG. 3 is a vertical cross-sectional view across the center of the valve 110 of the pump 100 for spraying a liquid based on an embodiment of the invention.

Referring to FIG. 2 and FIG. 3, the valve 110 may be structured to have the shape of a hollow cylinder with a valve flange 112 protruding outwards from the upper end thereof. The lower surface of the valve flange 112 may touch the upper end of the elastic member 170. A through-hole may be formed in the center of the valve 110. A button (not shown) of the pump may be coupled to an upper part of the valve 110, and a portion of the piston 130 and a portion of the guide 120 may be inserted into a lower part of the valve 110.

On the inner perimeter of the valve 110, there may be formed a coupler protrusion 114. The coupler protrusion 114 may be inserted into a coupler groove 124 formed in the periphery of the guide 120 inserted within the valve 110, so that the valve 110 and the guide 120 may move up or down together as an integrated body.

Figure 4:
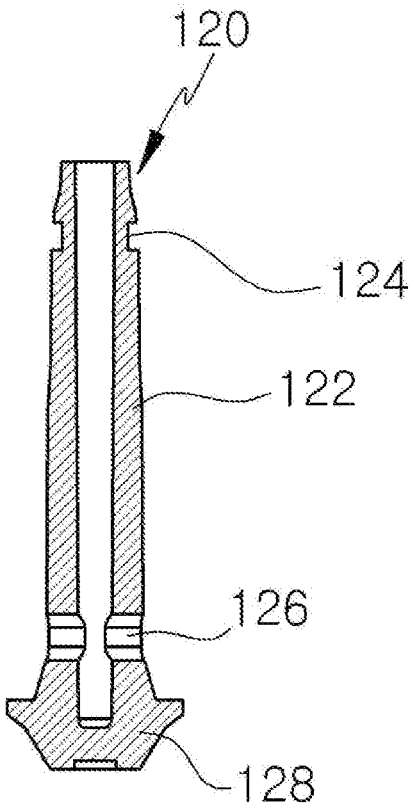
FIG. 4 is a vertical cross-sectional view across the center of the guide in the pump for spraying a liquid illustrated in FIG. 1.

FIG. 4 is a vertical cross-sectional view across the center of the guide 120 in the pump for spraying a liquid based on the first disclosed embodiment of the invention.

Referring to FIG. 2 and FIG. 4, the guide 120 may include a guide body 122, which may be inserted into the valve 110. The guide body 122 may have the shape of a hollow cylinder with its upper end open, connecting to the inside of the valve 110. Inlet holes 126 may be formed in the periphery of the guide body 122. The piston 130 can be put in tight contact around the inlet holes 126 and thus close the inlet holes 126.

At a lower end of the guide body 122, there may be formed a guide head 128. The guide head 128 may be a part that is formed with a larger diameter compared to the guide body 122 and may catch onto the lower part of the piston 130 when the guide 120 is moved upward such that the piston 130 is also moved upward together.

The piston 130 may tightly contact the outer perimeter of the guide body 122. The piston 130 may include a guide coupler portion 132 and a housing coupler portion 134.

The guide coupler portion 132 may tightly contact the outer perimeter of the guide body 122 and may have the shape of a hollow cylinder. The guide coupler portion 132 may close the inlet holes 126, and when the guide 120 is moved downward, the guide coupler portion 132 may move downward after a certain delay compared to the guide 120, to allow the inlet holes 126 to be open for a particular duration of time. The upper part of the guide coupler portion 132 may be inserted into the gap formed between the valve 110 and the guide 120.

The housing coupler portion 134 may have a larger diameter and a shorter length compared to the guide coupler portion 132 and may be disposed around the guide coupler portion 132. The housing coupler portion 134 may also have the shape of a hollow cylinder, and its outer perimeter may tightly contact the inner perimeter of the housing 150. Due to the housing coupler portion 134, the downward movement of the piston 130 may be delayed even as the guide 120 is moved downward.

Figure 6:
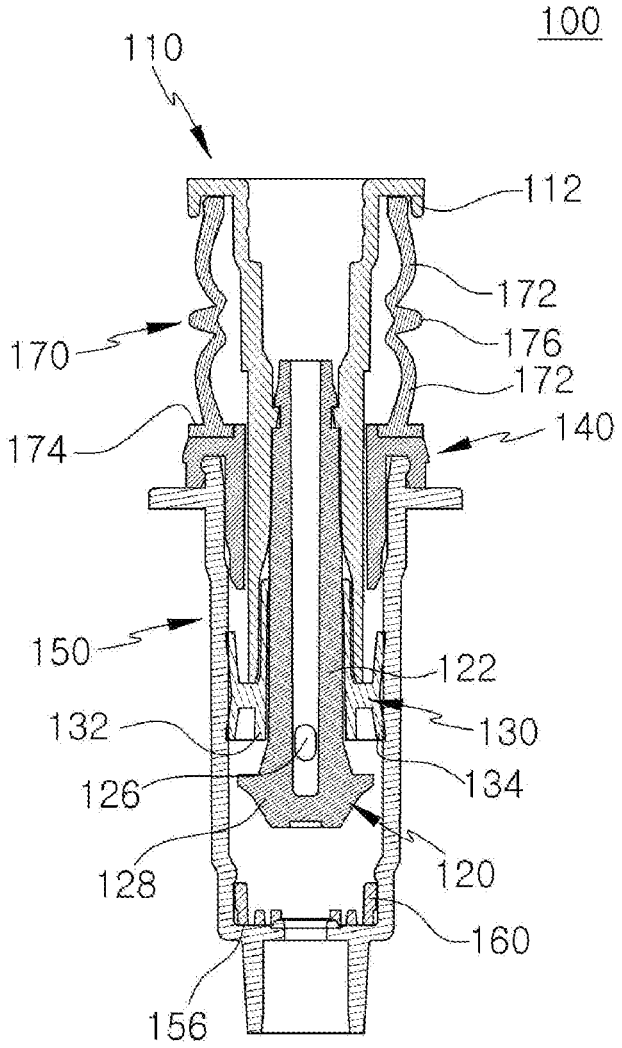
FIG. 6 is a cross-sectional view illustrating the guide opened by a pressing action from the state illustrated in FIG. 2.

FIG. 6 is a cross-sectional view across the center of the pump 100 for spraying a liquid after a downward pressing has compressed the elastic member 170 and opened the inlet holes 126 of the guide 120 from the state illustrated in FIG. 2.

Referring to FIG. 6, when the guide 120 is moved downward, the piston 130 may move downward with a certain delay due to friction with the inner perimeter of the housing 150. As a result, the inlet holes 126 of the guide 120 may be opened, and the content (not shown) that has entered the interior space 154 may be drawn in through the inlet holes 126 to the inside of the guide 120. When the guide 120 is moved upward, the piston 130 may be caught on the guide head 128 and be moved upward together with the guide 120.

Figure 5:
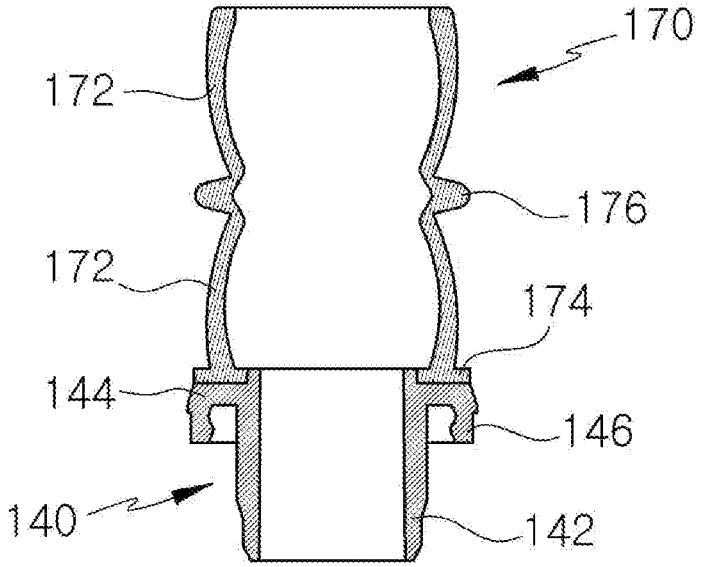
FIG. 5 is a vertical cross-sectional view across the center of the elastic member and the shoulder in the pump for spraying a liquid illustrated in FIG. 1.

FIG. 5 is a vertical cross-sectional view across the center of the shoulder 140 and elastic member 170 in the pump 100 for spraying a liquid based on the first disclosed embodiment of the invention.

Referring to FIG. 2 and FIG. 5, the shoulder 140 may include a shoulder body 142 that is inserted into the open top of the housing 150. The shoulder body 142 may have the shape of a hollow cylinder and may have the valve 110 inserted therein. On the periphery of the shoulder body 142, a shoulder flange 144 may protrude outward. A placement ring 174 of the elastic member 170 may be positioned on the upper surface of the shoulder flange 144. Also, at the end portion of the shoulder flange 144, there may be formed a shoulder periphery member 146 protruding downward. The shoulder periphery member 146 may touch the outer perimeter of the upper part of the housing 150, and a lower end of the shoulder periphery member 146 may touch the upper surface of the housing flange 152.

The housing 150 may be inserted through the opening at the upper part of the container (not shown) in which the content is stored. The housing 150 may include an interior space 154 into which the content may be drawn, where the guide 120 and the piston 130 may be positioned and undergo upward and downward movements within the interior space 154.

The housing 150 may be structured to have the shape of a hollow cylinder with both its top and bottom open. The housing flange 152 may protrude outward from the periphery of the housing 150. The housing flange 152 can be placed on an upper part of the container (not shown).

On the inside of the housing 150, there may be formed a placement step 156, which may have a decreased diameter. The disk can be positioned on the placement step 156. The disk 160 may be opened or closed by a pressure difference between the interior space 154 and the container. As the structure of the disk 160 is as disclosed in documents such as Korean Registered Patent No. 1975847, etc., the structure of the disk 160 will not be described here in further detail.

Figure 7:
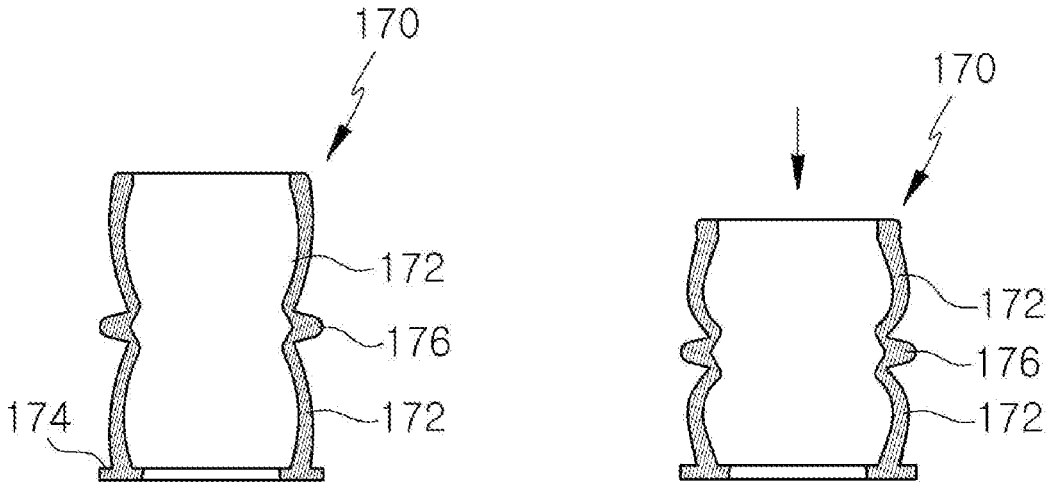
FIG. 7 is a vertical cross-sectional view illustrating the elastic member before and after compression in the pump for spraying a liquid illustrated in FIG. 1.

FIG. 7 is a vertical cross-sectional view across the center of the elastic member 170, illustrating the elastic member 170 before compression (left drawing) and after compression (right drawing).

Referring to FIG. 7, the elastic member 170 may be positioned between the valve flange 112 and the shoulder flange 144 and may serve to push the valve 110 upward. When an external force is applied, the elastic member 170 may experience an elastic deformation as the deformation portions 172 are compressed, and when the external force is removed, the elastic member 170 may elastically restore its original shape. In this way, the valve 110 may be raised or lowered by the elastic deformation and restoration of the elastic member 170.

In the center of the elastic member 170, there may be formed a center portion 176. The center portion 176 may have an annular shape and may be formed with a relatively greater thickness, so as to undergo little or no deformation even when an external force is applied.

The deformation portions 172 can be formed symmetrically on both ends of the elastic member 170. The deformation portions 172 may be formed with somewhat smaller thicknesses compared to the center portion 176 and may correspond to portions where deformation is relatively easier. Therefore, when an external force is applied, the deformation portions 172 formed above and below in an integrated form at both ends of the center portion 176 may be curved and deformed, allowing a downward movement of the valve 110. When the external force is removed, the deformation portions 172 may be elastically restored, and the valve 110 may be moved upward as a result.

At the lower end of the deformation portion 172 located at the bottom, there may be formed a placement ring 174. The placement ring 174 may rest on the upper surface of the shoulder flange 144 of the shoulder 140. The upper end of the deformation portion 172 located at the top may touch the lower surface of the valve flange 112.

The elastic member 170 based on this embodiment may have the non-deforming center portion 176 disposed at the center and the deformation portions 172 disposed on both ends thereof, thus providing the advantage of stable deformation and restoration. It is possible to fabricate the elastic member 170 and the shoulder 140 in an integrated form using the same or different materials.

Figure 8:
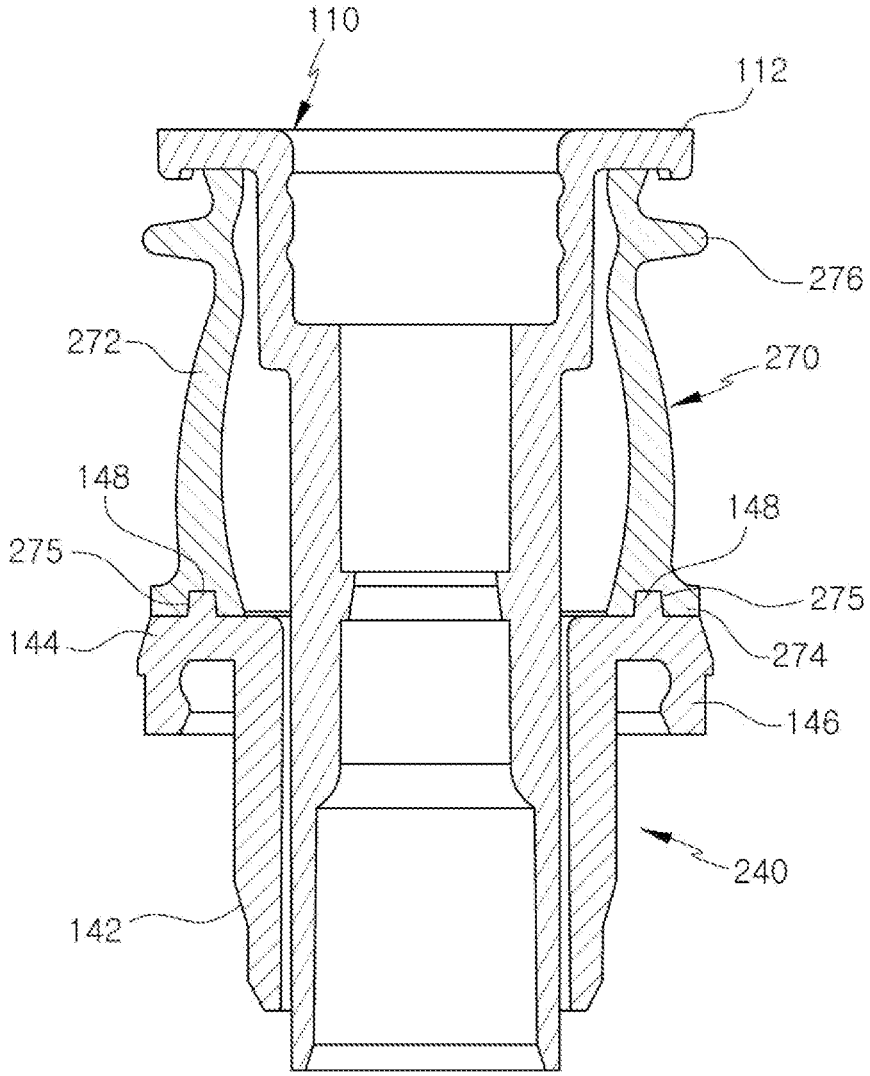
FIG. 8 is a cross-sectional view illustrating the shoulder and the elastic member in a pump for spraying a liquid according to a second disclosed embodiment of the invention.

FIG. 8 is a cross-sectional view illustrating the shoulder 240 and the elastic member 270 in a pump for spraying a liquid according to a second disclosed embodiment of the invention.

A pump for spraying a liquid based on the second disclosed embodiment of the invention may have substantially the same composition as that of the pump for spraying a liquid based on the first disclosed embodiment except for differences in the shoulder 240 and the elastic member 270.

Referring to FIG. 8, the shoulder 240 of a pump for spraying a liquid according to the second disclosed embodiment may be the same as the shoulder 140 in a pump 100 for spraying a liquid according to the first disclosed embodiment except that a shoulder protrusion 148 may be formed on the upper surface of the shoulder flange 144. The shoulder protrusion 148 may have an annular shape and may be inserted into an insertion groove 275 formed in the placement ring 274 of the elastic member 270 so as to support the elastic member 270 in a stable manner and prevent the elastic member 270 from becoming detached.

The elastic member 270 may have a composition substantially the same as or similar to that of the elastic member 170 in a pump for spraying a liquid based on the first disclosed embodiment, except that the center portion 176 may be substituted by a periphery member 276 that is located relatively higher and that the insertion groove 275 may be formed in the placement ring 274.

The periphery member 276 may be located at an upper part of the elastic member 270 instead of at the center along the longitudinal direction, as a result of which the deformation portion 272 may be increased in length to more readily undergo a deformation.

The placement ring 274 formed at the lower end of the elastic member 270 may be placed on the shoulder flange 144 of the shoulder 240. An insertion groove 275 may be formed in the lower surface of the placement ring 274. The shoulder protrusion 148 may be inserted in the insertion groove 275.

In a pump for spraying a liquid according to another embodiment of the invention, the insertion groove can be formed in the shoulder flange, and the protrusion inserted in the insertion groove can be provided on the placement ring of the elastic member.

Figure 9:
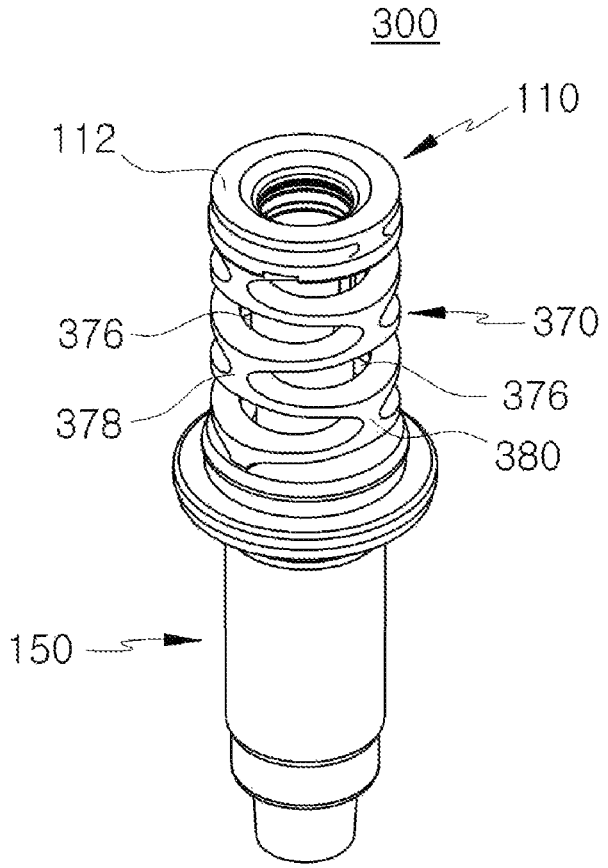
FIG. 9 is a perspective view illustrating a pump for spraying a liquid according to a third disclosed embodiment of the invention.
Figure 10:
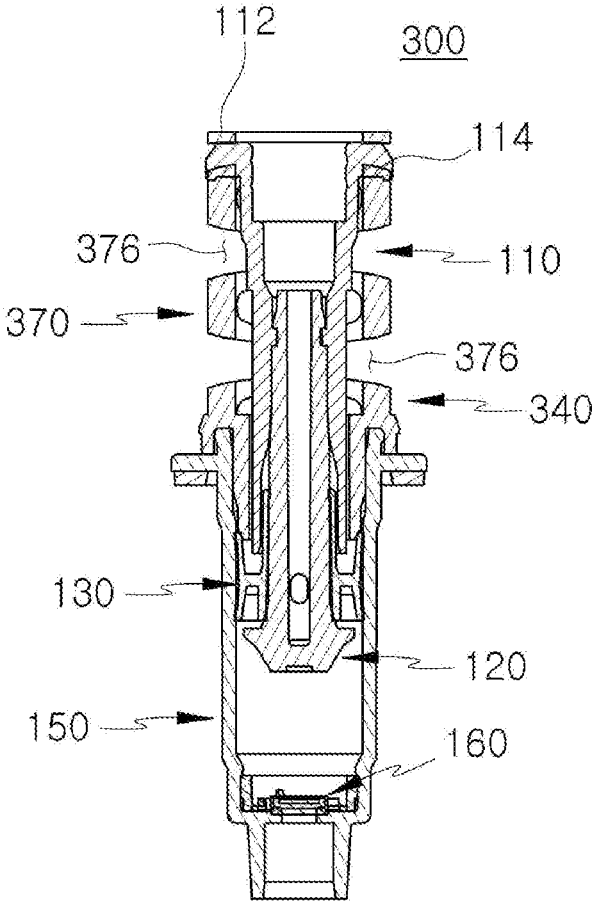
FIG. 10 is a vertical cross-sectional view of the pump for spraying a liquid across line A-A of FIG. 9.
Figure 11:
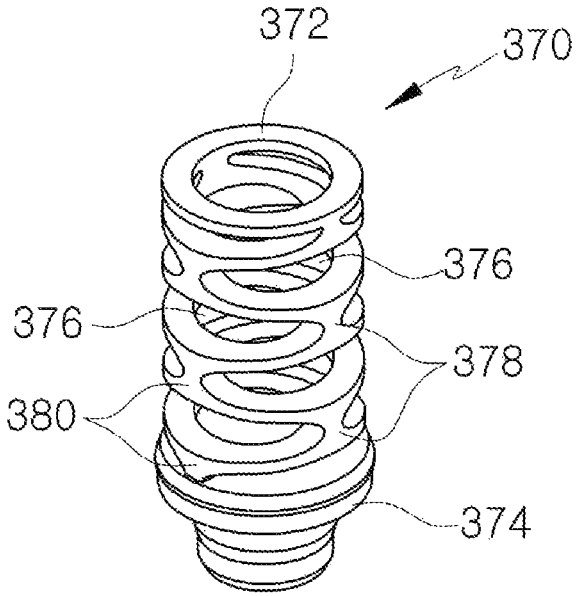
FIG. 11 is a perspective view illustrating the elastic member and the shoulder in the pump for spraying a liquid of FIG. 9.
Figure 12:
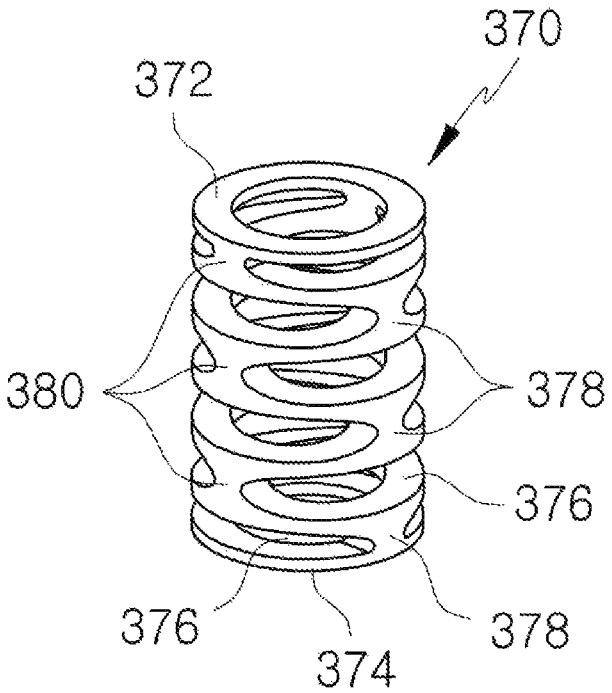
FIG. 12 is a perspective view of the elastic member in the pump for spraying a liquid according to the third disclosed embodiment of the invention.

FIG. 9 is a perspective view illustrating a pump 300 for spraying a liquid according to a third disclosed embodiment of the invention, and FIG. 10 is a vertical cross-sectional view of the pump 300 for spraying a liquid across line A-A of FIG. 9. FIG. 11 is a perspective view illustrating the elastic member 370 and the shoulder 340 in the pump 300 for spraying a liquid according to a third disclosed embodiment of the invention, and FIG. 12 is a perspective view illustrating the elastic member 370.

Referring to FIGS. 9 to 12, a pump 300 for spraying a liquid based on the third disclosed embodiment is characterized by the shape of the elastic member 370. The elastic member 370 may be fabricated by injection molding using a plastic resin and may include multiple slit portions 376 and connection portions 378, 380. An upper ring 372 corresponding to the upper end of the elastic member 370 can be formed as an integrated body with the shoulder 340.

A pump 300 for spraying a liquid based on this embodiment may include a valve 110, a guide 120, a piston 130, a shoulder 340, a housing 150, a disk 160, and an elastic member 370, among which the valve 110, guide 120, piston 130, housing 150, and disk 160 may be substantially the same in composition as those of the pump 100 for spraying a liquid based on the first disclosed embodiment and thus will not be described here in further detail.

The valve flange 112, which corresponds to the upper end of the valve 110, may have its lower surface contact the upper ring 372, which corresponds to the upper end of the elastic member 370, and thus may receive an elastic pressing force in an upward direction. A flange groove 114 formed concavely with a certain depth may be formed in the lower surface of the valve flange 112. The upper ring 372 of the elastic member 370 may be inserted into the flange groove 114, whereby the elastic member 370 can provide an elastic force in a stable manner without easily becoming detached from the valve flange 112.

The shoulder 340 may be inserted through the upper end of the housing 150 and may have substantially the same composition as the shoulder 140 of a pump 100 for spraying liquid based on the first disclosed embodiment. However, the shoulder 340 can be formed as an integrated body with the placement ring 374 corresponding to the lower end of the elastic member 370. Forming the elastic member 370 and the shoulder 340 as an integrated body in this manner can allow an easier fabrication of the pump 300.

The elastic member 370 may have the shape of a hollow cylinder, where slit portions 376 may be formed in certain intervals along its periphery. Because of the slit portions 376, the elastic member 370 may be structured as multiple rings interconnected by first connection portions 378 and second connection portions 380. The slit portions 376 allow the elastic member 370, which may be fabricated from a plastic resin, to be compressed and restored, thereby providing an elastic property.

The elastic member 370 may include multiple first connection portions 378 and second connection portions 380 formed alternatingly along the lengthwise direction. The first connection portions 378 and second connection portions 380 may be arranged in intervals of a 180-degree angle in pairs, where the pairs may be formed perpendicularly to one another. While the elastic member 370 can be formed as an integrated body with the shoulder 340, it is possible to form the elastic member 370 separately from the shoulder 340.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A pump for spraying liquid, the pump comprising:

a housing comprising an interior space configured to receive a content;

a guide configured to move up and down within the interior space and comprising an inlet hole capable of connecting with the interior space;

a piston configured to move according to an upward and a downward movement of the guide while maintaining contact with an inner perimeter of the housing and an outer perimeter of the guide and capable of closing the inlet hole;

a valve coupled to and connecting with an upper portion of the guide, the valve protruding to an exterior of the housing;

a shoulder coupled to an upper portion of the housing; and an elastic member having one end thereof contacting the shoulder and the other end thereof contacting the valve to provide an elastic force for pushing the valve upward, wherein the elastic member comprises a center portion and upper and lower deformation portions, the center portion being formed between the upper and lower deformation portions, the center portion and the deformation portions being formed as an integrated body, wherein each of the upper and lower deformation portions is a hollow vertical cylinder, wherein a diameter of a middle section of the hollow vertical cylinders is greater than diameters of upper and lower sections of the hollow vertical cylinders when the elastic member is pressed, wherein a radial thickness of the center portion is greater than a radial thickness of the hollow vertical cylinders, wherein the upper and lower deformation portions are symmetrical with respect to a horizontal axis, and wherein the lower deformation portion comprises a placement ring having a radial thickness being greater than a the radial thickness of the hollow vertical cylinders.

2. The pump for spraying liquid of according to claim 1, wherein the center portion is not deformed.

3. The pump for spraying liquid of according to claim 1, wherein the elastic member and the shoulder are formed as an integrated body.

4. The pump for spraying liquid of according to claim 1, wherein the housing, guide, piston, valve, shoulder, and elastic member are formed from a same material.

5. The pump for spraying liquid of according to claim 4, wherein the pump is formed from polypropylene (PP).

* * * * *